US007900468B2

(12) United States Patent
Spearing

(10) Patent No.: US 7,900,468 B2
(45) Date of Patent: Mar. 8, 2011

(54) METHOD AND APPARATUS FOR EQUALIZING A PUMPED REFRIGERANT SYSTEM

(75) Inventor: Ian Spearing, Westerville, OH (US)

(73) Assignee: Liebert Corporation, Columbus, OH (US)

( * ) Notice: Subject to any disclaimer, the term of this patent is extended or adjusted under 35 U.S.C. 154(b) by 496 days.

(21) Appl. No.: 12/034,477

(22) Filed: Feb. 20, 2008

(65) Prior Publication Data

US 2009/0013716 A1 Jan. 15, 2009

Related U.S. Application Data

(60) Provisional application No. 60/949,218, filed on Jul. 11, 2007.

(51) Int. Cl.
*F25D 23/00* (2006.01)

(52) U.S. Cl. ..... 62/259.2; 62/527

(58) Field of Classification Search ..... 165/80.2, 165/104.33; 361/687, 688, 699, 700; 62/527, 62/296, 228.3, 509, DIG. 17, 196.4, 278, 62/259.2, 126, DIG. 2

See application file for complete search history.

(56) References Cited

U.S. PATENT DOCUMENTS

| | | | | |
|---|---|---|---|---|
| 3,580,006 | A * | 5/1971 | Quick | 62/196.2 |
| 3,939,668 | A | 2/1976 | Morris | |
| 4,210,001 | A * | 7/1980 | Miller, Sr. | 62/468 |
| 4,503,685 | A * | 3/1985 | DiCarlo et al. | 62/193 |
| 4,589,263 | A | 5/1986 | DiCarlo et al. | |
| 5,411,078 | A * | 5/1995 | Ares | 165/113 |
| 6,272,870 | B1 * | 8/2001 | Schaeffer | 62/205 |
| 6,311,507 | B1 * | 11/2001 | Gameiro | 62/196.4 |
| 6,644,066 | B1 | 11/2003 | Dolcich | |
| 6,644,384 | B2 | 11/2003 | Stahl | |
| 6,761,212 | B2 | 7/2004 | DiPaolo | |
| 6,796,372 | B2 | 9/2004 | Bear | |
| 7,051,802 | B2 | 5/2006 | Baer | |
| 7,152,663 | B2 | 12/2006 | Helin et al. | |
| 7,367,384 | B2 | 5/2008 | Madara et al. | |
| 2004/0134637 | A1 | 7/2004 | Helin et al. | |
| 2006/0102322 | A1 | 5/2006 | Madara et al. | |
| 2006/0180301 | A1 | 8/2006 | Baer | |
| 2006/0191672 | A1 | 8/2006 | Stenhede et al. | |
| 2007/0030650 | A1 | 2/2007 | Madara et al. | |
| 2008/0018212 | A1 | 1/2008 | Spearing et al. | |

FOREIGN PATENT DOCUMENTS

| | | | |
|---|---|---|---|
| DE | 4315924 | A1 | 11/1994 |
| EP | 1662212 | A | 5/2006 |
| JP | 2002243290 | A | 8/2002 |
| JP | 2005172416 | A | 6/2005 |
| WO | 0146629 | A | 6/2001 |
| WO | 2005057097 | A | 6/2005 |

OTHER PUBLICATIONS

International Search Report for Corresponding International Patent Application No. US/2008/055539.

Written Opinion for Corresponding International Patent Application No. US/2008/055539.

Stenhede, C. "A Technical Reference Manual for Plate Heat Exchangers in Refrigeration & Air conditioning Applications." Fourth Edition, Jun. 2001, Alfa Laval AB, Sweden, pp. 104-105.

* cited by examiner

*Primary Examiner* — Mohammad M Ali

(74) *Attorney, Agent, or Firm* — Locke Lord Bissell & Liddell LLP

(57) ABSTRACT

A cooling system is provided that comprises: a refrigerant loop having a pump; an evaporator heat exchanger thermally coupled to a heat source, the evaporator plumbed in the loop; a condensing heat exchanger and a receiver plumbed in the loop; and an equalizing conduit plumbed between an inlet to the condenser and the receiver and comprising a flow regulating valve.

8 Claims, 7 Drawing Sheets

METHOD AND APPARATUS FOR EQUALIZING A PUMPED REFRIGERANT SYSTEM

CROSS REFERENCE TO RELATED APPLICATIONS

This application claims benefit of 60/949,218 filed on Jul. 11, 2007.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

The present disclosure generally relates to cooling systems, and more particularly, to a cooling system for a high-density heat load.

Electronic equipment in a critical space, such as a computer room or telecommunications room, requires precise, reliable control of room temperature, humidity, and airflow. Excessive heat or humidity can damage or impair the operation of computer systems and other components. For this reason, precision cooling systems are operated to provide cooling in these situations. However, problems may occur when cooling such high-density heat loads using a direct expansion (DX) cooling system. Existing DX systems for high-density loads monitor air temperatures and other variables to control the cooling capacity of the system in response to load changes. Thus, existing DX systems require rather sophisticated controls, temperature sensors, and other control components. Moreover, conventional computer room air conditioning systems require excessive floor space for managing high-density heat loads. Therefore, a need exists for a cooling system that is responsive to varying density heat loads and that requires less control of valves and other system components.

The inventions disclosed and taught herein are directed to an improved pumped refrigerant system.

BRIEF SUMMARY OF THE INVENTION

One aspect of the present invention comprises a cooling system having a refrigerant loop having a pump; an evaporator heat exchanger thermally coupled to a heat source, the evaporator plumbed in the loop; a condensing heat exchanger and a receiver plumbed in the loop; and an equalizing conduit plumbed between an inlet to the condenser and the receiver and comprising a flow regulating valve.

DETAILED DESCRIPTION

Figure 1:
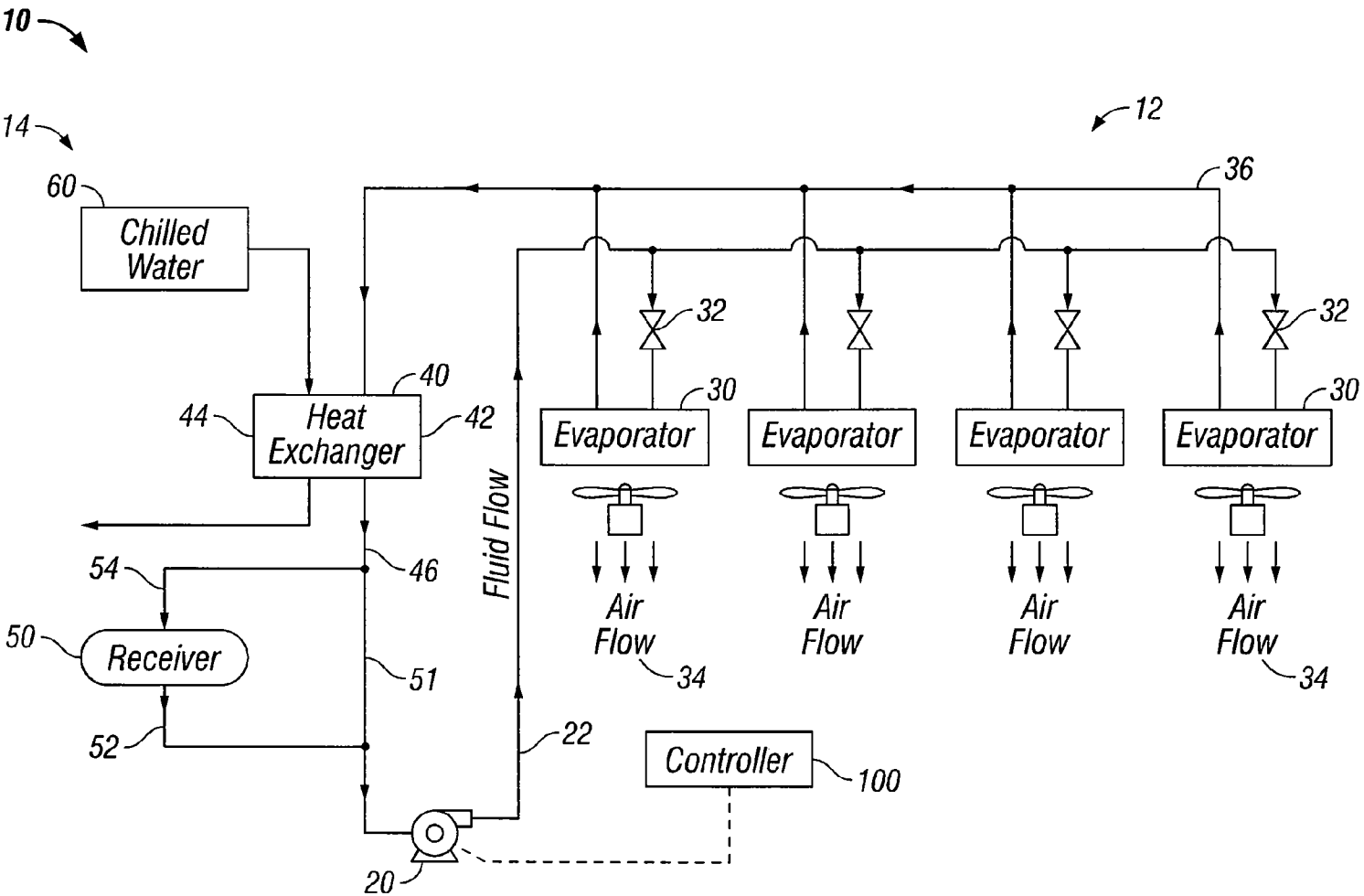
FIG. 1 schematically illustrates one embodiment of a cooling system according to certain teachings of the present disclosure.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Particular embodiments of the invention may be described below with reference to block diagrams and/or operational illustrations of methods. It will be understood that each block of the block diagrams and/or operational illustrations, and combinations of blocks in the block diagrams and/or operational illustrations, can be implemented by analog and/or digital hardware, and/or computer program instructions. Such computer program instructions may be provided to a processor of a general-purpose computer, special purpose computer, ASIC, and/or other programmable data processing system. The executed instructions may create structures and functions for implementing the actions specified in the block diagrams and/or operational illustrations. In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

Computer programs for use with or by the embodiments disclosed herein may be written in an object oriented programming language, conventional procedural programming language, or lower-level code, such as assembly language and/or microcode. The program may be executed entirely on a single processor and/or across multiple processors, as a stand-alone software package or as part of another software package.

Figure 2:
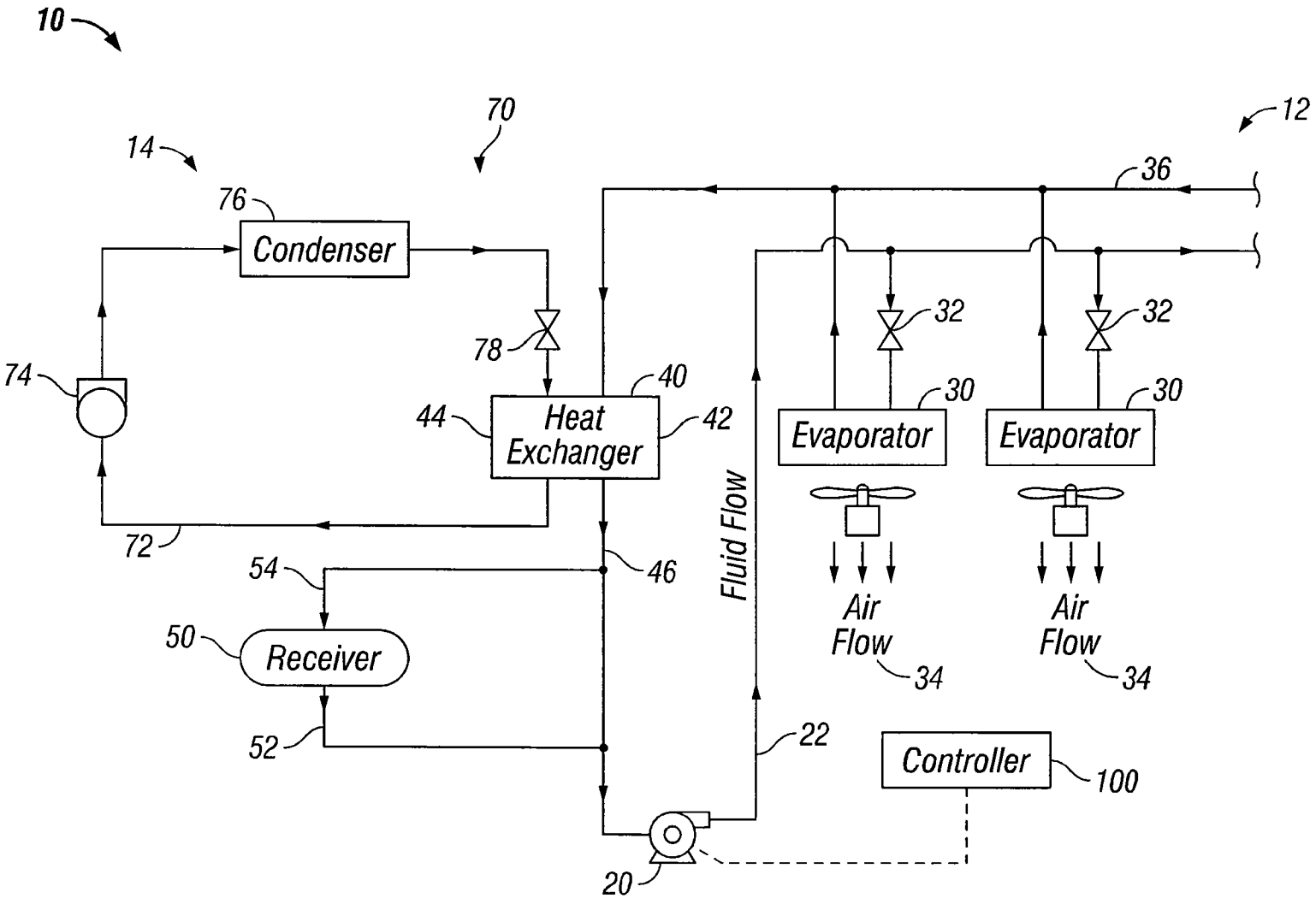
FIG. 2 schematically illustrates another embodiment of a cooling system according to certain teachings of the present disclosure.

Referring to FIGS. 1 and 2, the disclosed cooling system 10 includes a first cooling cycle 12 in thermal communication with a second cycle 14. The disclosed cooling system 10 also includes a control system 100. Both the first and second cycles 12 and 14 include independent working fluids. The working fluid in the first cycle is any volatile fluid suitable for use as a conventional refrigerant, including but not limited to chlorofluorocarbons (CFCs), hydrofluorocarbons (HFCs), or hydrochloro-fluorocarbons (HCFCs). Use of a volatile working fluid eliminates the need for using water located above sensitive equipment, as is sometimes done in conventional systems for cooling computer room. The first cycle 12 includes one or more pumps 20, one or more first heat exchangers (evaporators) 30, a second heat exchanger 40, and piping to interconnect the various components of the first cycle 12. The first cycle 12 is not a vapor compression refrigeration system. Instead, the first cycle 12 uses the pump 20 instead of a compressor to circulate a volatile working fluid for removing heat from a heat load. The pump 20 is preferably capable of pumping the volatile working fluid throughout the first cooling cycle 12 and is preferably controlled by the control system 100.

The first heat exchanger 30 is an air-to-fluid heat exchanger that removes heat from the heat load (not shown) to the first working fluid as the first working fluid passes through the first fluid path in first heat exchanger 30. For example, the air-to-fluid heat exchanger 30 can include a plurality of tubes for the working fluid arranged to allow warm air to pass therebetween. It will be appreciated that a number of air-to-fluid heat exchangers known in the art can be used with the disclosed cooling system 10. A flow regulator 32 can be connected between the piping 22 and the inlet of the evaporator 30 to regulate the flow of working fluid into the evaporator 30. The flow regulator 32 can be a solenoid valve or other type of device for regulating flow in the cooling system 10. The flow regulator 32 preferably maintains a constant output flow independent of the inlet pressure over the operating pressure range of the system. In the embodiment of FIGS. 1 and 2, the first cycle 12 includes a plurality of evaporators 30 and flow regulators 32 connected to the piping 22. However, the disclosed system can have one or more than one evaporator 30 and flow regulators 32 connected to the piping 22. Additionally, the one or more evaporators may alternatively be fluid-to-fluid or even fluid-to-solid heat exchangers.

The second heat exchanger 40 is a fluid-to-fluid heat exchanger that transfers the heat from the first working fluid to the second cycle 14. It will be appreciated that a number of fluid-to-fluid heat exchangers known in the art can be used with the disclosed cooling system 10. For example, the fluid-to-fluid heat exchanger 40 can include a plurality of tubes for one fluid positioned in a chamber or shell containing the second fluid. A coaxial ("tube-in-tube") exchanger would also be suitable. In certain embodiments, it is preferred to use a plate heat exchanger. The first cycle 12 can also include a receiver 50 connected to the outlet piping 46 of the second heat exchanger 40 by a bypass line 52. The receiver 50 may store and accumulate the working fluid in the first cycle 12 to allow for changes in the temperature and heat load.

In one embodiment, the air-to-fluid heat exchanger 30 can be used to cool a room holding computer equipment. For example, a fan 34 can draw air from the room (heat load) through the heat exchanger 30 where the first working fluid absorbs heat from the air. In another embodiment, the air-to-fluid heat exchanger 30 can be used to directly remove heat from electronic equipment (heat load) that generates the heat by mounting the heat exchanger 30 on or close to the equipment. For example, electronic equipment is typically contained in an enclosure (not shown), such as computer equipment. The heat exchanger 30 can mount to the enclosure, and fans 34 can draw air from the enclosure through the heat exchanger 30. Alternatively, the first exchanger 30 may be in direct thermal contact with the heat source (e.g. a cold plate) or may cool a fluid loop in direct contact with the heat source. It will be appreciated by those skilled in the art that the heat transfer rates, sizes, and other design variables of the components of the disclosed cooling system 10 depend on the size of the disclosed cooling system 10, the magnitude of the heat load to be managed, and on other details of the particular implementation.

In the embodiment of the disclosed cooling system 10 depicted in FIG. 1, the second cycle 14 includes a chilled water cycle 60 connected to the fluid-to-fluid heat exchanger 40 of the first cycle 12. In particular, the second heat exchanger 40 has first and second portions or fluid paths 42 and 44 in thermal communication with one another. The first path 42 for the volatile working fluid is connected between the first heat exchanger 30 and the pump. The second fluid path 44 is connected to the chilled water cycle 60. The chilled water cycle 60 may be similar to those known in the art. The chilled water system 60 includes a second working fluid that absorbs heat from the first working fluid passing through the fluid-to-fluid heat exchanger 40. The second working fluid is then chilled by techniques known in the art for a conventional chilled water cycle. In general, the second working fluid can be either volatile or non-volatile. For example, in the embodiment of FIG. 1, the second working fluid can be water, glycol or mixtures thereof. Therefore, the embodiment of the first cycle 12 in FIG. 1 can be constructed as an independent unit that houses the pump 20, air-to-fluid heat exchanger 30, and fluid-to-fluid heat exchanger 40 and can be connected to an existing chilled water service that is available in the building housing the equipment to be cooled, for example. Additionally, the entire first cycle 12 or any portion thereof may be housed in or mounted to an enclosure containing the heat load.

In the embodiment of the disclosed cooling system 10 in FIG. 2, the first cycle 12 is substantially the same as that described above. However, the second cycle 14 includes a vapor compression refrigeration system 70 connected to the second portion or flow path 44 of heat exchanger 40 of the first cycle 12. Instead of using chilled water to remove the heat from the first cycle 12 as in the embodiment of FIG. 1, the refrigeration system 70 in FIG. 2 is directly connected to or is the "other half" of the fluid-to-fluid heat exchanger 40. The vapor compression refrigeration system 70 can be substantially similar to those known in the art. An exemplary vapor compression refrigeration system 70 includes a compressor 74, a condenser 76, and an expansion device 78. Piping 72 connects these components to one another and to the second flow path 44 of the heat exchanger 40.

The vapor compression refrigeration system 70 removes heat from the first working fluid passing through the second heat exchanger 40 by absorbing heat from the exchanger 40 with a second working fluid and expelling that heat to the environment (not shown). The second working fluid can be either volatile or non-volatile. For example, in the embodiment of FIG. 2, the second working fluid can be any conventional chemical refrigerant, including but not limited to chlorofluorocarbons (CFCs), hydrofluorocarbons (HFCs), or hydrochloro-fluorocarbons (HCFCs). The expansion device 78 can be a valve, orifice or other apparatus known to those skilled in the art to produce a pressure drop in the working fluid passing therethrough. The compressor 74 can be any type of compressor known in the art to be suitable for refrigerant service such as reciprocating compressors, scroll compressors, or the like. In the embodiment depicted in FIG. 2, the cooling system 10 is self-contained. For example, the vapor compression refrigeration system 70 can be part of a single unit that also houses pump 20 and fluid-to-fluid heat exchanger 30.

Figure 3:
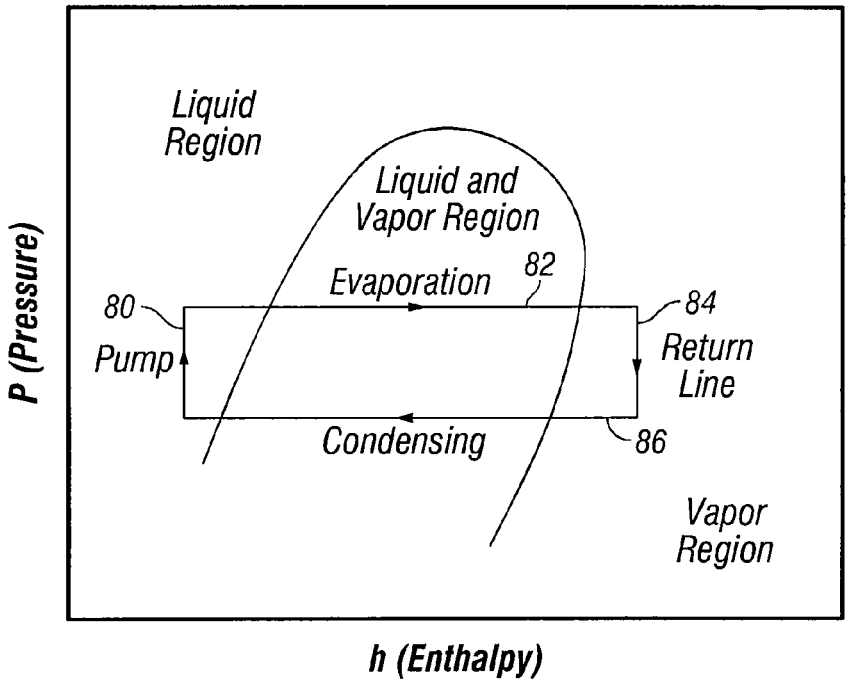
FIG. 3 illustrates a cycle diagram of the disclosed cooling system.

During operation of the disclosed system, pump 20 moves the working fluid via piping 22 to the air-to-fluid heat exchanger 30. Pumping increases the pressure of the working fluid, while its enthalpy remains substantially the same. (See leg 80 of the cycle diagram in FIG. 3). The pumped working fluid can then enter the air-to-fluid heat exchanger or evaporator 30 of the first cycle 12. A fan 34 can draw air from the heat load through the heat exchanger 30. As the warm air from the heat load (not shown) enters the air-to-fluid heat exchanger 30, the volatile working fluid absorbs the heat. As the fluid warms through the heat exchanger, some of the volatile working fluid will evaporate. (See leg 82 of the cycle diagram in FIG. 3). In a fully loaded system 10, the fluid leaving the first heat exchanger 30 may be a saturated vapor. The fluid from the first heat exchangers 30 may be in virtually any state from still sub-cooled, to saturated liquid, to two-phase, to saturated vapor, through superheated vapor. Preferably, however, the fluid leaving the first heat exchanger 30 would be either two-phase or saturated vapor.

In any case, the vapor flows from the heat exchanger 30 through the piping 36 to the fluid-to-fluid heat exchanger 40. In the piping or return line 36, the working fluid is in the vapor state, and the pressure of the fluid drops while its enthalpy remains substantially constant. (See leg 84 of the cycle diagram in FIG. 3). At the fluid-to-fluid heat exchanger 40, the vapor in the first fluid path 42 is condensed by transferring heat to the second, colder fluid of the second cycle 12 in the second fluid path 44. (See leg 86 of the cycle diagram in FIG. 3). The condensed working fluid leaves the heat exchanger 40 via piping 44 and enters the pump 20, where the first cycle 12 can be repeated.

Figure 4:
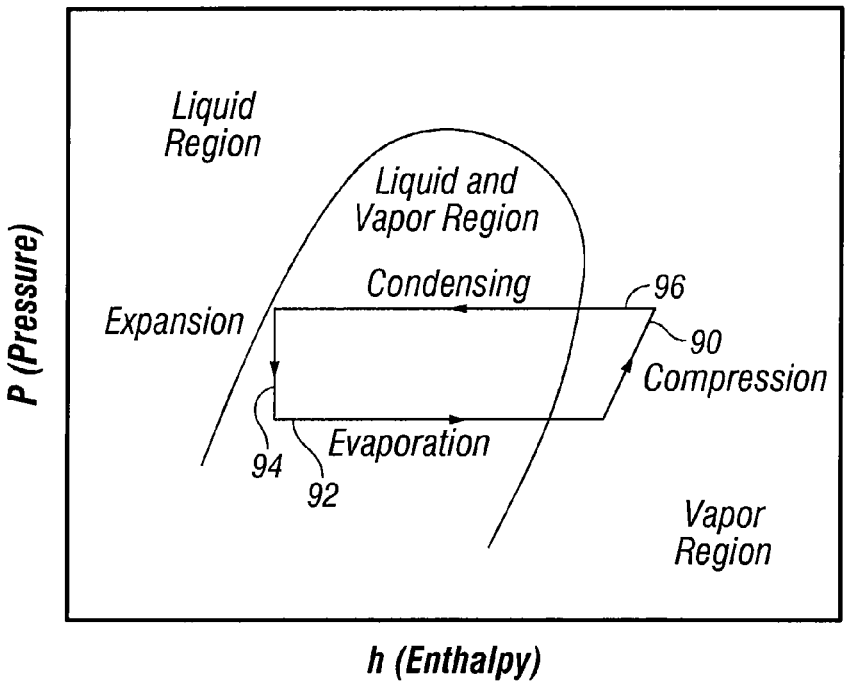
FIG. 4 illustrates a cycle diagram of a typical vapor compression refrigeration system.

The second cooling cycle 14 operates in conjunction with first cycle 12 to remove heat from the first cycle 12 by absorbing the heat from the first working fluid into the second working fluid and rejecting the heat to the environment (not shown). As noted above, the second cycle 14 can include a chilled water system 60 as shown in FIG. 1 or a vapor compression refrigeration system 70 as shown in FIG. 2. During operation of chilled water system 60 in FIG. 1, for example, a second working fluid can flow through the second fluid path 44 of heat exchanger 40 and can be cooled in a water tower (not shown). During operation of refrigeration system 70 in FIG. 2, for example, the second working fluid passes through the second portion 44 of fluid-to-fluid heat exchanger 40 and absorbs heat from the volatile fluid in the first cycle 12. The working fluid evaporates in the process. (See leg 92 of the typical vapor-compression refrigeration cycle depicted in FIG. 4). The vapor travels to the compressor 74 where the working fluid is compressed. (See leg 90 of the refrigeration cycle in FIG. 4). The compressor 74 can be a reciprocating, scroll or other type of compressor known in the art. After compression, the working fluid travels through a discharge line to the condenser 76, where heat from the working fluid is dissipated to an external heat sink, e.g., the outdoor environment. (See leg 96 of the refrigeration cycle in FIG. 4). Upon leaving condenser 76, refrigerant flows through a liquid line to expansion device 75. As the refrigerant passes through the expansion device 75, the second working fluid experiences a pressure drop. (See leg 94 of the refrigeration cycle in FIG. 4.) Upon leaving expansion device 75, the working fluid flows through the second fluid path of fluid-to-fluid heat exchanger 40, which acts as an evaporator for the refrigeration cycle 70.

Conventional cooling systems for computer rooms or the like take up valuable floor space. The present cooling system 10, however, can cool high-density heat loads without consuming valuable floor space. Furthermore, in comparison to conventional types of cooling solutions for high-density loads, such as computing rooms, cooling system 10 conserves energy, because pumping a volatile fluid requires less energy than pumping a non-volatile fluid such as water. In addition, pumping the volatile fluid reduces the size of the pump that is required as well as the overall size and cost of the piping that interconnects the system components.

The disclosed system 10 advantageously uses the phase change of a volatile fluid to increase the cooling capacity per square foot of a space or room. In addition, the disclosed system 10 also eliminates the need for water in cooling equipment mounted above computing equipment, which presents certain risks of damage to the computing equipment in the event of a leak. Moreover, since the system is designed to remove sensible heat only, the need for condensate removal is eliminated. As is known in the art, cooling air to a low temperature increases the relative humidity, meaning condensation is likely to occur. If the evaporator is mounted on an electronics enclosure, for example, condensation may occur within the enclosure, which poses significant risk to the electronic equipment. In the present system, the temperature in the environment surrounding the equipment is maintained above the dew point to ensure that condensation does not occur. Because the disclosed cooling system does not perform latent cooling, all of the cooling capacity of the system will be used to cool the computing equipment.

The disclosed cooling system 10 can handle varying heat loads without the complex control required on conventional direct expansion systems. The system is self-regulating in that the pump 20 provides a constant flow of volatile fluid to the system. The flow regulators 32 operate so as to limit the maximum flow to each heat exchanger 30. This action balances the flow to each heat exchanger 30 so that each one gets approximately the same fluid flow. If a heat exchanger is under "high" load, then the volatile fluid will tend to flash off at a higher rate than one under a lower load. Without the flow regulator 32, more of the flow would tend to go to the "lower" load heat exchanger because it is the colder spot and lower fluid pressure drop. This action would tend to "starve" the heat exchanger under high load and it would not cool the load properly.

The key system control parameter that is used to maintain all sensible cooling is the dewpoint in the space to be controlled. The disclosed cooling system 10 controls either the chilled water or the vapor compression system so that the fluid going to the above mentioned heat exchangers 30 is always above the dewpoint in the space to be controlled. Staying above the dewpoint insures that no latent cooling can occur.

In cooling systems such as those illustrated FIGS. 1 and 2, a transient effect may occur on decreasing heat load. The pumped refrigerant (system) pressure may drop until the chilled water valve controlling the heat exchanger 40 can adapt to the decreased load conditions. When the thermal load drops, the system pressure drops and then the refrigerant temperature at the inlet to the pump 20 drops. A control system, such as controller 100 in FIG. 1, may respond to the decreased refrigerant temperature by reducing the cooling provided by the heat exchanger 40 (such as by closing the chilled water valve). During this transient, the pumps 20 circulating the coolant (e.g., R134a) may cavitate because the fluid entering the pumps has, initially, the same temperature as before the thermal load decreased, but it is at a lower pressure because of the drop in system pressure.

These factors correspond to less sub-cooling of the pumped refrigerant and, correspondingly, less Net Positive Suction Head Available (NPSHa) at the pump(s) 20 inlet. If the NPSHa is less than the Required Net Positive Suction Head (NPSHr) of the pump at the pump's particular operating point, then the pump will tend to cavitate, which can cause anything from a slight decrease in flow output to complete loss of flow.

To address these issues, an equalization line may be adapted to allow the higher-pressure vapor of the heat exchanger 40 return line 36 to increase the system pressure in the pump 20 inlet line, which increases the pump NPSHa. Further, the equalization line may decrease the pressure drop across the heat exchanger 40 which slows the fluid movement in the heat exchanger 40, which increases its residence time, which in turn increases the amount of heat transferred out of the condensed liquid, which corresponds to colder fluid out from the heat exchanger 40, which again increases the NPSHa to the pumps 20.

Returning to FIG. 1, for example, the pumped refrigerant return line 36 is plumbed into the condensing heat exchanger 40 and from the condenser 40 to the receiver 50 with a bypass line 51 from the condenser to the pumps. The majority of the refrigerant flow typically passes through the bypass 51, due to the pipe elevation and routing at the junction of the bypass to pump 20 versus the inlet to the receiver 50. Some portion of the flow may also enter the receiver 50 through a vent or fill pipe 54. On increasing thermal load, the amount of return refrigerant exceeds the pump 20 draw, so, by definition, the receiver 50 receives refrigerant, either by filling from the top of the receiver 50 through pipe 54 or by percolating into the bottom of the receiver 50 via the bypass line 51 connections, or both.

In this arrangement, the receiver 50 assumes a pressure based on any vapor that exits the condenser 40 plus any tendency for the condenser 40 to draw vapor out of the receiver 50 through the pipe 54 plus any heat leak into or out of the receiver tank 50.

Since the bypass 51 around the receiver tank 50 is most likely to get the main refrigerant flow and the receiver 50 typically contains slightly warmer refrigerant than in the bypass line 51, the receiver 50 tends to maintain a pressure slightly above that of the liquid in the bypass line 51.

It is proposed to increase the receiver 50 average pressure and temperature by adding another bypass or equalization line, this time from the refrigerant return line 36 to the receiver 50. The line may be, and preferably is, positioned to transfer mostly if not entirely vapor and to have this vapor enter the vapor space the in receiver 50. This will have the effect of raising the average vapor pressure in the receiver tank 50, and therefore, depending on the rate of heat transfer of the vapor to the contained sub-cooled liquid, increasing sub-cooling to the pumps 20. Additionally, the equalization line should slow the liquid moving through the condenser 40, increase the liquid level in the condenser 40, and reduce the available pressure drop across the condenser 40 and therefore increases the NPSHa to the pump 20.

Figure 5:
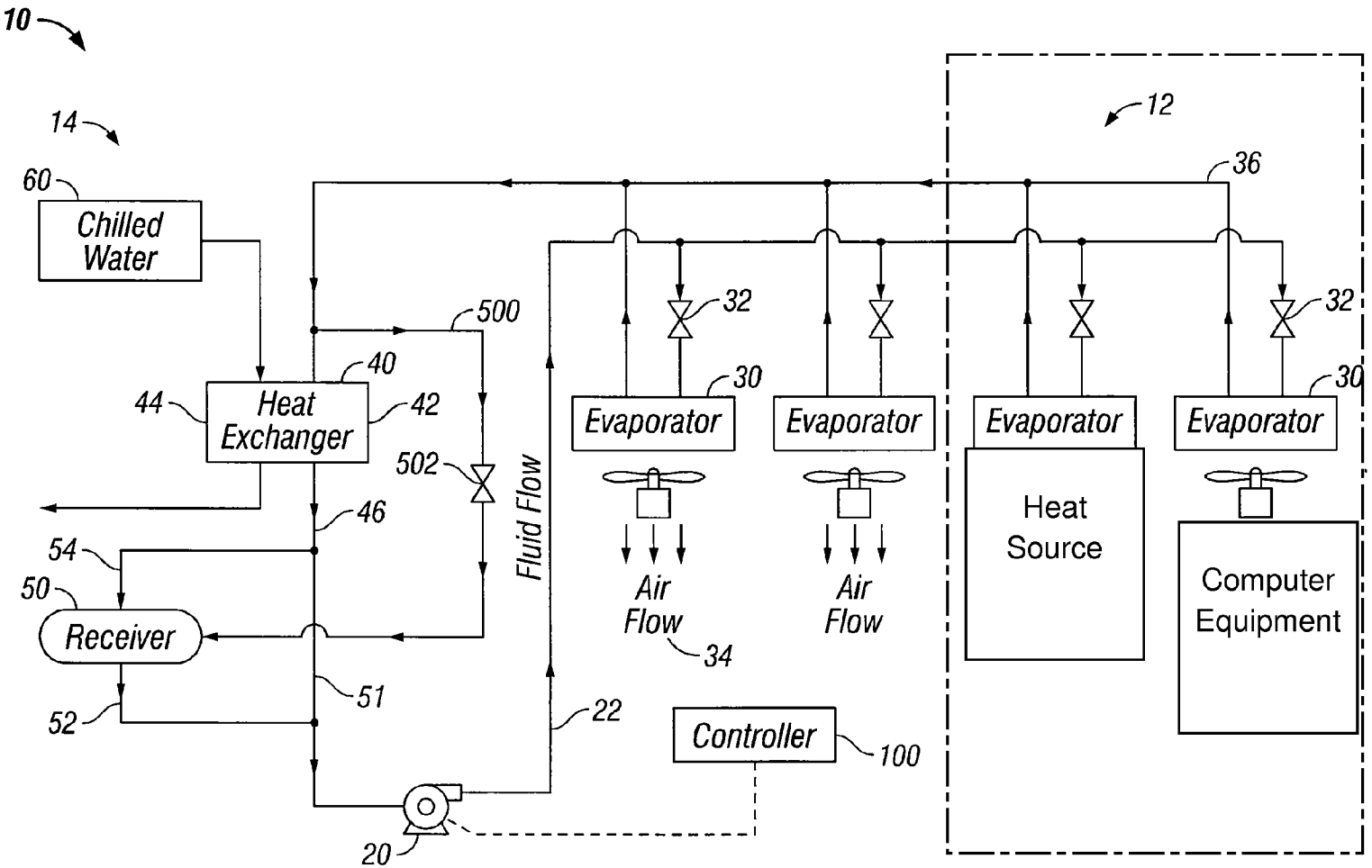
FIG. 5 illustrates the embodiment shown in FIG. 1 with an equalization line according to certain teachings of the present disclosure.

As illustrated in FIG. 5, a cooling system 10 such as described with respect to FIG. 1, may be adapted with an equalization line 500. The line 500 may be sized to some flow impedance at some operating point, or sized with an on/off valve, or may be a line with a manually controlled valve for creating variable flow impedance, or may be a line with an electronically, pneumatically, or mechanically controlled valve with variable flow impedance. The line 500 is plumbed between the inlet to the condensing heat exchanger 40 (e.g., the coolant return line from thermal loads) and the outlet 46 of the condensing heat exchanger 40 (e.g., the supply of condensed liquid to the coolant circulating pumps). Alternatively, the line 500 may be plumbed or placed between the inlet to the condensing heat exchanger and the inlet of the vapor space of the system liquid receiver 50 (e.g., the reservoir of condensed liquid to supply coolant circulating pumps). The net impedance of the line 500 with or without a valve 502 is selected (either statically during design or dynamically during operation of the system) so that the overall system maximizes cooling performance and maintains the required NPSHa to the system pumps 20 to ensure reliable operation at all times, including during transient load changes.

For a valve 502 that is electronically, pneumatically, or mechanically controlled, a control signal from the system, such as controller 100, is used to set the valve position. Generally, opening the valve during decreasing system thermal loads helps to counteract the tendency of the system pressure and NPSHa to decrease, and, generally, closing the valve during increasing system thermal loads helps to counteract the tendency of the system pressure and NPSHa to increase. The valve is preferably positioned at an optimum point that meets the NPSHr of the system pump while maximizing the system cooling capacity at a given discharge coolant temperature by closing/opening the valve to the point where NPSHa at the pump inlet equals or slightly exceeds NPSHr. Thus, the controller 100 controls both the pump 20 speed and the Net Positive Suction Head Available (NPSHa) at the pump(s) 20. The controller 100 therefore may monitor the pressure drop across the condensing heat exchanger 40 and/or the inlet pressure of the pump 20. The controller 100 may alternatively or additionally monitor any combination of any other relevant variable related the pump 20, such as an inlet temperature of the pump 20, the power consumption of the pump 20 with respect to a measured flow, sound and/or vibration indicating cavitation, partial cavitation, or no cavitation in the pump 20 or inlet lines to the pump 20, or any suitable variables relating to NPSHa and/or cavitation.

This invention allows a means of increasing the sub-cooling available from a pumped refrigerant system, which increases the NPSHa to the system pump, which improves the pump's reliability and performance during low thermal load and/or transient load decreases. By adjusting the valve position, either initially or during operation, the sub-cooling of the coolant discharged from the heat exchanger can be adjusted and/or optimized to maximize reliability of the pump during low load and transient load changes while maintaining a minimum sub-cooling so that the overall cooling capacity of the heat exchanger and pumped refrigerant system is not compromised.

Figure 6:
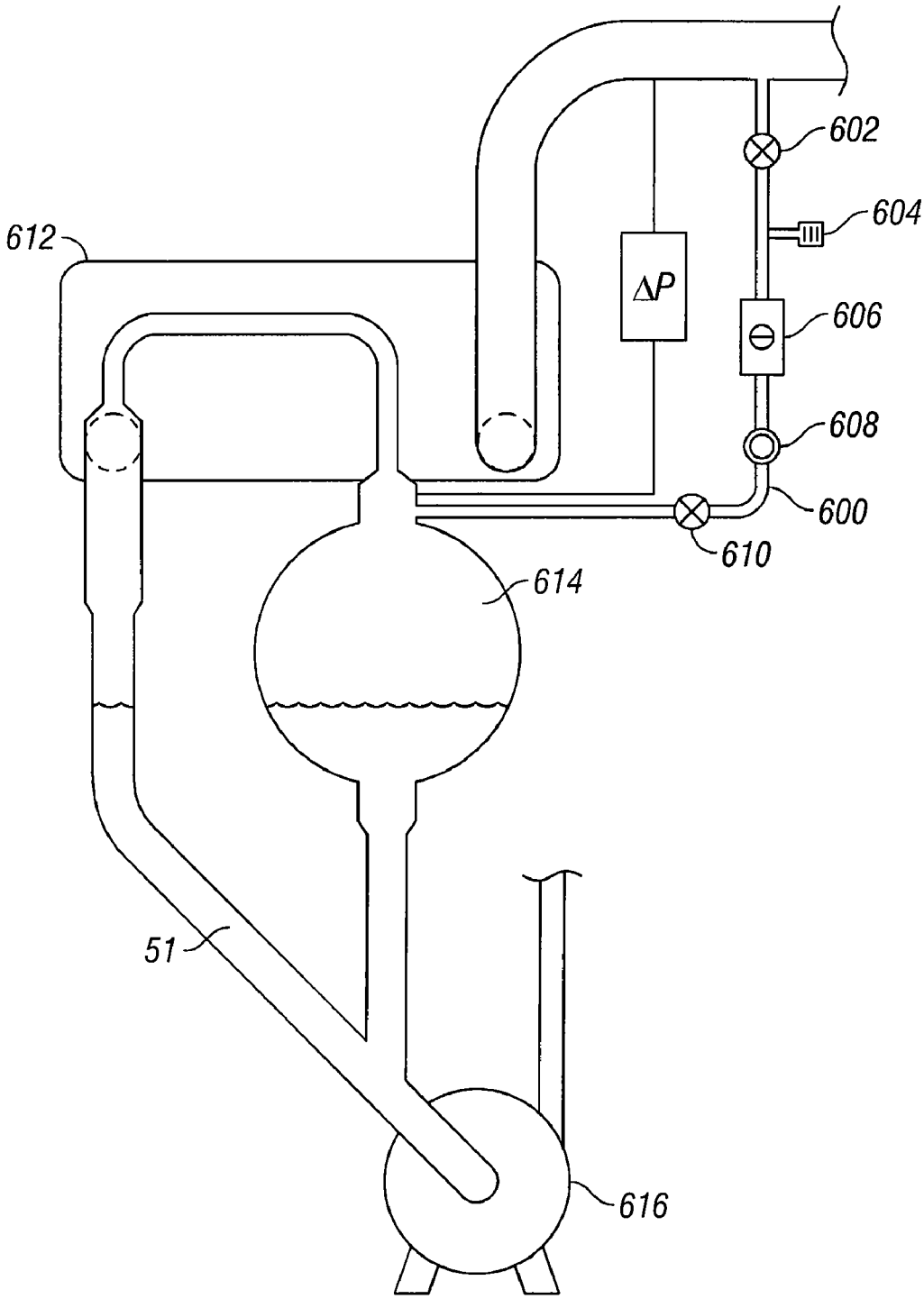
FIG. 6 illustrates a preferred embodiment of an equalization line for a cooling system with a valve in the equalization line closed.
Figure 7:
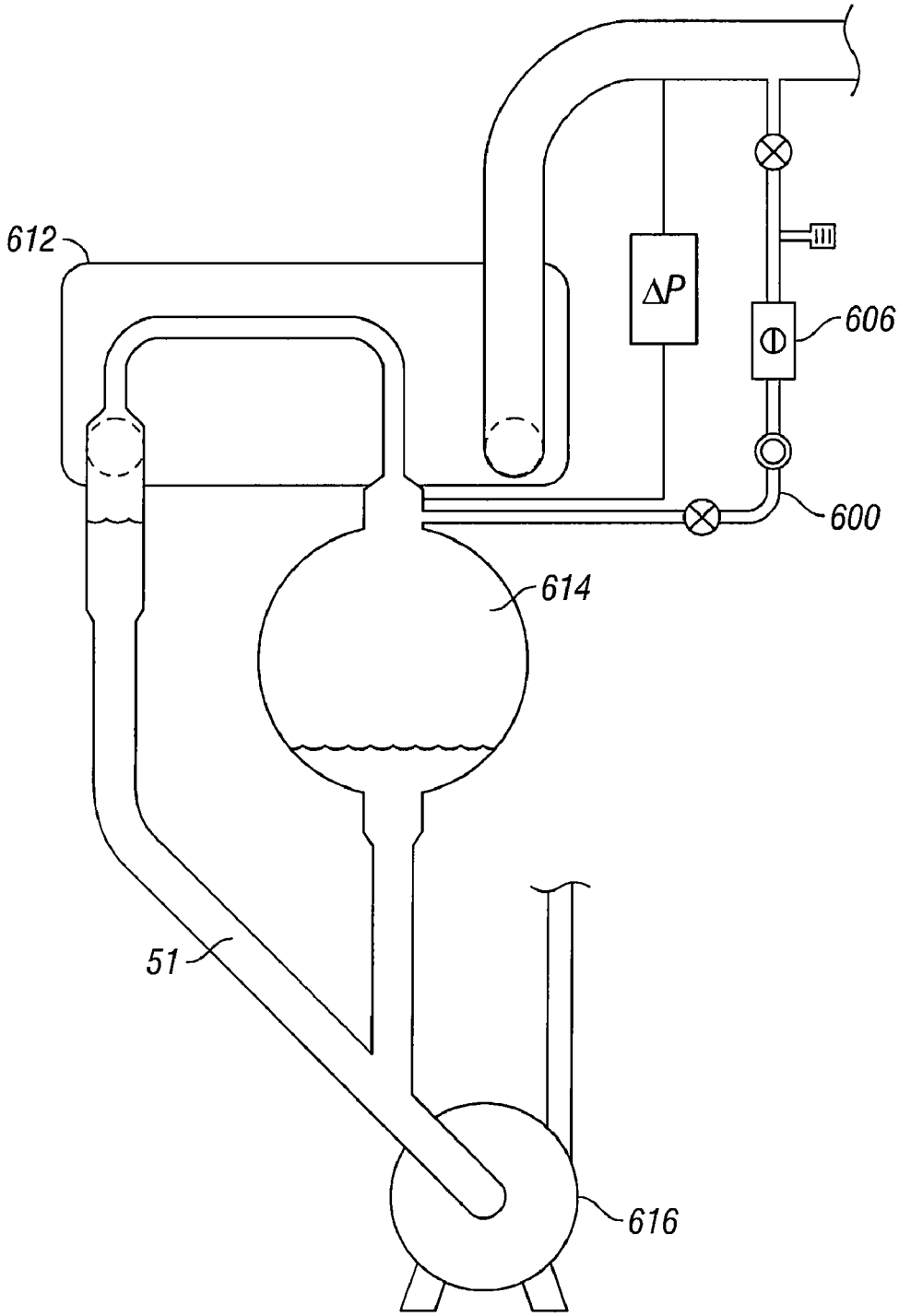
FIG. 7 illustrates the preferred embodiment of the equalization line with the valve open.

FIGS. 6 and 7 illustrate a preferred form of an equalization line 600 comprising an on/off valve 602, such as a ball valve, and/or a Schrader valve 604, and/or a manual or automatic regulating valve 606, such as described above, and/or a sight glass 608 and/or another on/off valve 610, such as a ball valve. The ball valves 602,610 allow isolation of the equalizing line 600. Together with the Schrader valve 604, they allow the equalization line 600 to be evacuated for configuration, maintenance, and/or replacement of the regulating valve 606. The sight glass 608 provides visual confirmation of flow through the equalizing line 600. Thus, in the preferred embodiment, the only necessary component in the equalization line 600 is the regulating valve 606. However, in some embodiments, careful sizing of the equalization line 600 itself may make the regulating valve 606 unnecessary.

As illustrated, the line 600 is plumbed between the inlet to the condensing heat exchanger 612 and the inlet to the receiver 614. In certain embodiments, the pressure drop across condenser 612 can be monitored and the information used to adjust the flow through the equalization line 600. Alternately, the pump 616 inlet pressure, pump 616 inlet fluid turbulence or other pump parameter may be monitored and the information used to control the flow of refrigerant through the equalization line 600.

FIGS. 6 and 7 also show a preferred physical relationship of select components of the system 10. Specifically, the condenser 621 is preferably positioned above the receiver 614, which is preferably positioned above the pump 616. FIG. 6 shows an exemplary fluid level in the receiver 614 and the bypass line 51 being roughly equal, when the regulating valve 606 is substantially fully closed. This is due to the fact that both the receiver 614 and the bypass line 51 are exposed to substantially the same pressure, namely that of the outlet of the condenser 612. However, as FIG. 7 shows, with the regulating valve 606 substantially fully open, an exemplary fluid level in the receiver 614 is expected to be much lower than that in the bypass line 51 due to the receiver's 614 exposure to the pressure of the inlet to the condenser 612 through the equalizing line 600. It should be noted that the levels, or difference in levels, described herein are expected to vary depending on to what extent the regulating valve 606 is opened or closed, along with other factors such as the pressures and temperatures of the overall system and the refrigerant.

Figure 8:
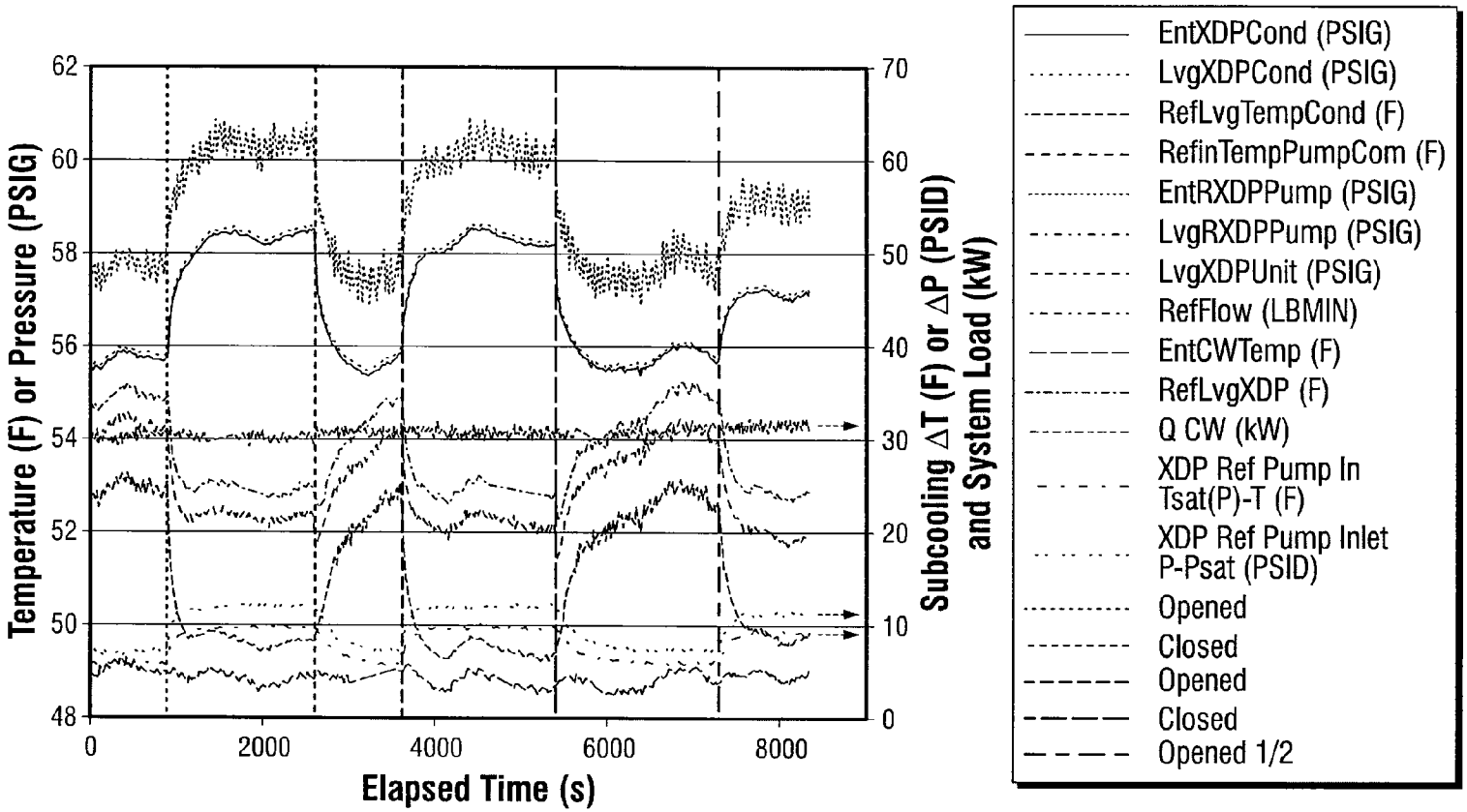
FIG. 8 graphically illustrates test results from a chilled water-cooled, pumped refrigerant cooling system utilizing an equalization line.

Presented below are test results from a chilled water-cooled, pumped refrigerant cooling system utilizing an equalization line as described herein. These tests results are illustrated graphically in FIG. 8.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to fully protect all such modifications and improvements that come within the scope or range of equivalent of the following claims.

The invention claimed is:

1. A cooling system, comprising:

a refrigerant loop having a pump;

an evaporator heat exchanger thermally coupled to a heat source, the evaporator plumbed in the loop;

a condensing heat exchanger and a receiver, both the condensing heat exchanger and the receiver being plumbed in the loop; and an equalizing conduit plumbed between an inlet to the condenser and an inlet to the receiver, equalizing conduit including a regulating valve that opens and closes in an effort to maintain an inlet pressure to the pump.

2. The system as set forth in claim 1, wherein the valve is opened and closed in response to a pressure drop across the condensing heat exchanger.

3. The system as set forth in claim 1, further comprising a controller operable to control the pump's speed to ensure adequate refrigerant flow through the loop to adequately cool the heat source and control the valve to maintain an inlet pressure to the pump to ensure that the pump does not cavitate.

| Date/Time | EventType | ChannelID | Description |
|---|---|---|---|
| Mon Aug. 15, 2005, 8:41:19 AM | Start | 0 | Test Started - Immediate |
| Mon Aug. 15, 2005, 8:41:20 AM | User | 0 | Set conditions for receiver equalization line test; 240 V; All fans at full speed; 30 kW Heat load |
| Mon Aug. 15, 2005, 8:56:14 AM | User | 0 | Opened receiver equalization valve at this exact time. |
| Mon Aug. 15, 2005, 9:24:41 AM | User | 0 | Closed receiver equalization valve |
| Mon Aug. 15, 2005, 9:41:43 AM | User | 0 | Opened receiver equalization valve |
| Mon Aug. 15, 2005, 10:11:18 AM | User | 0 | Closed receiver equalization valve |
| Mon Aug. 15, 2005, 10:42:58 AM | User | 0 | Open receiver equalization valve ½ way |
| Mon Aug. 15, 2005, 11:00:11 AM | User | 0 | END TEST |
| Mon Aug. 15, 2005, 11:00:23 AM | Stop | 0 | Test Terminated - By User |

Other and further embodiments utilizing one or more aspects of the inventions described above can be devised without departing from the spirit of Applicant's invention. Discussion of singular elements can include plural elements and vice-versa.

4. The system as set forth in claim 1, wherein the valve is opened during decreasing thermal loads and closed during increasing thermal loads.

5. The system as set forth in claim 1, wherein the evaporator heat exchanger is maintained above the dew point to ensure that condensation does not occur.

6. The system as set forth in claim 1, wherein the heat source is computer equipment and the evaporator heat exchanger is mounted within an enclosure for the computer equipment.

7. The system as set forth in claim 1, wherein the valve is a pressure regulating valve.

8. A cooling system, comprising:

a refrigerant loop having a pump circulating a volatile fluid therein;

an air-to-fluid evaporator heat exchanger mounted within an enclosure to extract heat from computer equipment in the enclosure, the evaporator plumbed in the loop;

a condensing heat exchanger and a receiver, both the condensing heat exchanger and the receiver being plumbed in the loop;

an equalizing conduit plumbed between an inlet to the condenser and the receiver, the equalizing conduit including a regulating valve that opens and closes in an effort to maintain an inlet pressure to the pump; and a controller operable to control the pump's speed to ensure adequate refrigerant flow through the loop to adequately cool the computer equipment and control the valve to maintain an inlet pressure to the pump to ensure that the pump does not cavitate by opening the valve during decreasing thermal loads and closing the valve during increasing thermal loads, and wherein the controller controls the valve using at least one input selected from the group consisting of a pressure drop across the condensing heat exchanger, the inlet pressure of the pump, an inlet temperature of the pump, a power consumption of the pump, a flow rate through the pump, a power consumption of the pump with respect to a flow rate through the pump, a sound emanating from the pump, a vibration of the pump, a vibration of inlet piping to the pump.

* * * * *